US010769921B2

(12) United States Patent
Patel et al.

(10) Patent No.: US 10,769,921 B2
(45) Date of Patent: Sep. 8, 2020

(54) SMOKE DETECTOR

(71) Applicant: CARRIER CORPORATION, Jupiter, FL (US)

(72) Inventors: Vipul Patel, Sarasota, FL (US); Dennis Michael Gadonniex, Bradenton, FL (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/320,054

(22) PCT Filed: Aug. 4, 2017

(86) PCT No.: PCT/US2017/045441
§ 371 (c)(1),
(2) Date: Jan. 23, 2019

(87) PCT Pub. No.: WO2018/027104
PCT Pub. Date: Feb. 8, 2018

(65) Prior Publication Data

US 2019/0266868 A1 Aug. 29, 2019

Related U.S. Application Data

(60) Provisional application No. 62/370,755, filed on Aug. 4, 2016.

(51) Int. Cl.
*G08B 17/107* (2006.01)
*G08B 29/14* (2006.01)
*G08B 29/18* (2006.01)

(52) U.S. Cl.
CPC ..... *G08B 17/107* (2013.01); *G08B 29/145* (2013.01); *G08B 29/183* (2013.01)

(58) Field of Classification Search
CPC ... G08B 17/107; G08B 29/145; G08B 29/183
(Continued)

(56) References Cited

U.S. PATENT DOCUMENTS 5,576,697 A 11/1996 Nagashima et al.
6,011,478 A 1/2000 Suzuki et al.
(Continued)

FOREIGN PATENT DOCUMENTS

DE 202015000820 U1 3/2015
DE 102014014797 A1 9/2015
(Continued)

OTHER PUBLICATIONS

ISR/WO, dated Nov. 8, 2017, U301184PCT, PCT Application No. PCT/US17/45441, 13 pages total.
Lang; "Multi-Criteria Fire Detection"; Feb. 2011; 24 pgs.

*Primary Examiner* — Hirdepal Singh
(74) *Attorney, Agent, or Firm* — Cantor Colburn LLP

(57) ABSTRACT

A smoke detector is provided and includes a housing defining a chamber receptive of ambient materials, one or more receivers disposed to receive light reflected from the chamber along one or more receiving axes, respectively, and multiple emitters disposed to emit light of multiple wavelengths, respectively, into the chamber at multiple angles relative to each of the one or more receiving axes, respectively, and a controller. The controller is configured to determine whether a current condition of the chamber should trigger an alarm based on output signals generated by the one or more receivers resulting from light emitted into the chamber by the multiple emitters being reflected toward the one or more receivers by the ambient materials.

17 Claims, 5 Drawing Sheets

(58) Field of Classification Search
USPC ..... 340/630
See application file for complete search history.

(56) References Cited

U.S. PATENT DOCUMENTS

| | | | | |
|---|---|---|---|---|
| 6,218,950 | B1 | 4/2001 | Politze et al. | |
| 6,326,897 | B2 | 12/2001 | Kadwell et al. | |
| 6,377,345 | B1 | 4/2002 | Powell | |
| 6,515,589 | B2 | 2/2003 | Schneider et al. | |
| 6,818,893 | B2 | 11/2004 | Carter | |
| 6,828,913 | B2 | 12/2004 | Oppelt et al. | |
| 6,876,305 | B2 | 4/2005 | Kadwell et al. | |
| 6,967,582 | B2 | 11/2005 | Tice et al. | |
| 7,075,445 | B2 | 7/2006 | Booth et al. | |
| 7,075,646 | B2 | 7/2006 | Cole et al. | |
| 7,233,253 | B2 | 6/2007 | Qualey, III | |
| 7,239,387 | B2 | 7/2007 | Politze et al. | |
| 7,483,139 | B2 * | 1/2009 | Powell | G01N 21/0303 356/437 |
| 7,616,126 | B2 | 11/2009 | Kadwell et al. | |
| 7,724,367 | B2 | 5/2010 | Cole | |
| 7,746,239 | B2 | 6/2010 | Nagashima | |
| 7,760,102 | B2 | 7/2010 | Chabanis et al. | |
| 7,978,087 | B2 | 7/2011 | Siber et al. | |
| 7,983,445 | B2 | 7/2011 | Knox et al. | |
| 8,035,527 | B2 | 10/2011 | Powell | |
| 8,085,157 | B2 | 12/2011 | Luterotti | |
| 8,269,639 | B2 | 9/2012 | Cole | |
| 8,546,740 | B2 | 10/2013 | Vollenweider | |
| 8,559,006 | B2 | 10/2013 | Penney et al. | |
| 8,587,442 | B2 | 11/2013 | Loepfe et al. | |
| 8,638,436 | B2 | 1/2014 | Dohi | |
| 8,797,531 | B2 | 8/2014 | Knox et al. | |
| 8,866,083 | B2 | 10/2014 | Brigham et al. | |
| 8,890,700 | B2 | 11/2014 | Cole | |
| 8,907,802 | B2 | 12/2014 | Erdtmann | |
| 8,941,505 | B2 | 1/2015 | Dohi | |
| 8,947,243 | B2 | 2/2015 | Erdtmann | |
| 8,947,244 | B2 | 2/2015 | Erdtmann | |
| 8,952,821 | B2 | 2/2015 | Erdnnann M | |
| 9,013,317 | B2 | 4/2015 | Brigham et al. | |
| 9,036,150 | B2 | 5/2015 | Wedler et al. | |
| 9,053,620 | B2 | 6/2015 | Clossen-Von et al. | |
| 9,098,989 | B2 | 8/2015 | Fischer | |
| 9,140,646 | B2 | 9/2015 | Erdtmann | |
| 9,142,112 | B2 | 9/2015 | Erdtmann | |
| 9,142,113 | B2 | 9/2015 | Erdtmann | |
| 9,157,854 | B2 | 10/2015 | Matsukuma | |
| 9,244,010 | B2 | 1/2016 | Wagner et al. | |
| 2007/0229824 | A1 * | 10/2007 | Politze | G08B 17/107 356/336 |
| 2009/0128353 | A1 * | 5/2009 | Gonzales | G08B 25/04 340/691.5 |
| 2011/0194111 | A1 * | 8/2011 | Dohi | G08B 29/18 356/340 |
| 2013/0176131 | A1 * | 7/2013 | Pichard | G08B 29/043 340/630 |
| 2013/0286391 | A1 | 10/2013 | Erdtmann | |
| 2013/0286392 | A1 | 10/2013 | Erdtmann | |
| 2013/0286393 | A1 | 10/2013 | Erdtmann | |
| 2014/0333928 | A1 | 11/2014 | Erdtmann | |
| 2015/0077737 | A1 * | 3/2015 | Belinsky | G01N 21/53 356/51 |
| 2015/0102934 | A1 | 4/2015 | Erdtmann | |
| 2015/0102935 | A1 | 4/2015 | Erdtmann | |
| 2015/0103346 | A1 | 4/2015 | Erdtmann | |
| 2015/0116711 | A1 | 4/2015 | Erdtmann | |
| 2015/0170490 | A1 | 6/2015 | Shaw | |
| 2015/0228171 | A1 | 8/2015 | Aebersold | |
| 2015/0346086 | A1 * | 12/2015 | Erdtmann | G01N 21/274 250/574 |
| 2019/0005793 | A1 * | 1/2019 | Stibich | G08B 17/11 |

FOREIGN PATENT DOCUMENTS

| | | | | |
|---|---|---|---|---|
| EP | 1887536 | A1 | 2/2008 | |
| EP | 2093733 | A1 | 8/2009 | |
| EP | 2685437 | A1 | 1/2014 | |
| EP | 2844984 | A1 | 3/2015 | |
| EP | 2848913 | A1 | 3/2015 | |
| GB | 2397122 | A | 7/2004 | |
| JP | 3939900 | B2 | 7/2007 | |
| WO | 2000007161 | A1 | 2/2000 | |
| WO | WO-0007161 | A1 * | 2/2000 | G01N 21/53 |
| WO | 2013165713 | A1 | 11/2013 | |
| WO | 2015021428 | A1 | 2/2015 | |
| WO | 2015065965 | A1 | 5/2015 | |

* cited by examiner

SMOKE DETECTOR

BACKGROUND OF THE DISCLOSURE

The subject matter disclosed herein relates to smoke detectors and, more particularly, to photo-electric smoke detectors using multiple light emitters and receivers.

A smoke detector is a device that detects smoke and issues an alarm. A photo-electric smoke detector, meanwhile, is a type of smoke detector that works based on light reflection principals and generally includes a light emitter, a light receiver and an optic chamber. When there is no smoke in the optic chamber and the optic chamber is empty or mostly empty, the light receiver typically receives a small amount of light reflected from chamber surfaces. On the other hand, when smoke is present in the optic chamber, the light receiver receives more light due to that light being reflected from the smoke particles. When an amount of the received light exceeds a predetermined level, an alarm is triggered.

As operated in this manner, photo-electric smoke detectors are not able to discriminate between large-size non-smoke particles, such as steam clouds, dust clouds, etc., and small-size non-smoke particles that are generated by certain types of cooking scenarios. That is, photo-electric smoke detectors are not capable of determining when small-size non-smoke particles are generated by safe activities, such as broiling hamburgers, toasting bread, etc., and thus permit false alarms to be triggered.

As a result, photo-electric smoke detectors will not pass upcoming, new Underwriter Laboratories (UL) 217-8 and 268-7 standards which require that smoke detectors and photo-electric smoke detectors, in particular, be configured to not sound an alarm during "broiling hamburger" tests.

BRIEF DESCRIPTION OF THE DISCLOSURE

According to one aspect of the disclosure, a smoke detector is provided and includes a housing defining a chamber receptive of ambient materials, a receiver disposed to receive light reflected from the chamber along a receiving axis, first, second and third emitters disposed to emit light of first, second and first wavelengths, respectively, into the chamber at first, first and second angles relative to the receiving axis, respectively, and a controller. The controller is configured to determine whether a current condition of the chamber should trigger an alarm based on output signals generated by the receiver resulting from light emitted into the chamber by the first, second and third emitters being reflected toward the receiver by the ambient materials.

In accordance with additional or alternative embodiments, the ambient materials include air and smoke and non-smoke particles carried by the air.

In accordance with additional or alternative embodiments, the first angle relative to the receiving axis includes an obtuse angle, the second angle relative to the receiving axis includes an acute angle and the light of the first and second wavelengths includes long and short wave light, respectively.

In accordance with additional or alternative embodiments, the controller includes a signal processing and alarm decision unit and a light emitter driver and current controller to control operations of the first, second and third emitters.

In accordance with additional or alternative embodiments, the controller receives first, second and third output signals from the receiver, calculates first, second and third output signal ratios and determines whether the current condition should trigger the alarm based on respective durations of the first, second and third output signal ratios.

In accordance with additional or alternative embodiments, the first, second and third output signal ratios are indicative of a real fire or a nuisance.

In accordance with additional or alternative embodiments, the controller determines whether the current condition should trigger the alarm based on first, second and third output signal durations.

In accordance with additional or alternative embodiments, the controller is configured to determine whether the current condition should trigger an alarm in satisfaction of UL 217-8 standards.

In accordance with additional or alternative embodiments, the controller is configured to determine whether the current condition should trigger an alarm in satisfaction of UL 217-8 and 268-7 standards.

In accordance with additional or alternative embodiments, the receiver and the first, second and third emitters are mounted at similar or varied angles relative to a plane.

According to another aspect of the disclosure, a smoke detector is provided and includes a housing defining a chamber receptive of ambient materials, first and second receivers disposed to receive light reflected from the chamber along first and second receiving axes, respectively, first and second emitters disposed to emit light of first and second wavelengths, respectively, into the chamber at first and second and third and fourth angles relative to each of the first and second receiving axes, respectively, a controller. The controller is configured to determine whether a current condition of the chamber should trigger an alarm based on output signals generated by the first and second receivers resulting from light emitted into the chamber by the first and second emitters being reflected toward the first and second receivers by the ambient materials.

In accordance with additional or alternative embodiments, the ambient materials include air and smoke and non-smoke particles carried by the air.

In accordance with additional or alternative embodiments, the first angle is greater than the second angle, the third angle is greater than the fourth angle, the first and third angles are obtuse, the second and fourth angles are acute and the light of the first and second wavelengths comprises long and short wave light, respectively.

In accordance with additional or alternative embodiments, the controller includes a signal processing and alarm decision unit and a light emitter driver and current controller to control operations of the first, second and third emitters.

In accordance with additional or alternative embodiments, the controller receives first and second output signals from the first receiver and third and fourth output signals from the second receiver, calculates first, second, third and fourth output signal ratios and determines whether the current condition should trigger the alarm based on respective durations of the first, second, third and fourth output signal ratios.

In accordance with additional or alternative embodiments, the first, second, third and fourth output signal ratios are indicative of a real fire or a nuisance.

In accordance with additional or alternative embodiments, the controller determines whether the current condition should trigger the alarm based on first, second and third output signal durations.

In accordance with additional or alternative embodiments, the controller is configured to determine whether the current condition should trigger an alarm in satisfaction of UL 217-8 standards.

In accordance with additional or alternative embodiments, the controller is configured to determine whether the current condition should trigger an alarm in satisfaction of UL 217-8 and 268-7 standards.

In accordance with additional or alternative embodiments, the receiver and the first, second and third emitters are mounted at similar or varied angles relative to a plane.

According to yet another aspect of the disclosure, a method of operating a smoke detector is provided. The smoke detector includes a housing defining a chamber, one or more receivers disposed to receive light reflected from the chamber along one or more receiving axes, respectively, and multiple emitters disposed to emit light of multiple wavelengths, respectively, into the chamber at multiple angles relative to each of the one or more receiving axes, respectively. The method include receiving, from the one or more receivers, output signals resulting from light emitted into the chamber by the multiple emitters being reflected toward the one or more receivers by ambient materials in the chamber, and determining whether a current condition of the chamber should trigger an alarm based on output signal ratios calculated from the output signals and output signal durations.

In accordance with additional or alternative embodiments, the determining includes filtering the output signals and calculating the output signal ratios.

In accordance with additional or alternative embodiments, the output signal ratios and the output signal durations are indicative of the current condition being a real fire or a nuisance.

In accordance with additional or alternative embodiments, the determining satisfies UL 217-8 standards.

In accordance with additional or alternative embodiments, the determining satisfies UL 217-8 and 268-7 standards.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION OF THE DISCLOSURE

As will be described below, a smoke detector is provided as a photo-electric smoke detector. The photo-electric smoke detector is able to discriminate between large-size non-smoke particles, such as steam clouds, dust clouds, etc., and small-size non-smoke particles that are generated by certain types of cooking scenarios. The photo-electric smoke detector is capable of determining when the small-size non-smoke particles are generated by safe activities, such as broiling hamburgers, toasting bread, etc., and thus prevents false alarms from being triggered. As a result, the photo-electric smoke detector will pass the UL 217-8 and 268-7 standards which require that smoke detectors and photo-electric smoke detectors, in particular, be configured to not sound an alarm during "broiling hamburger" tests.

Figure 1:
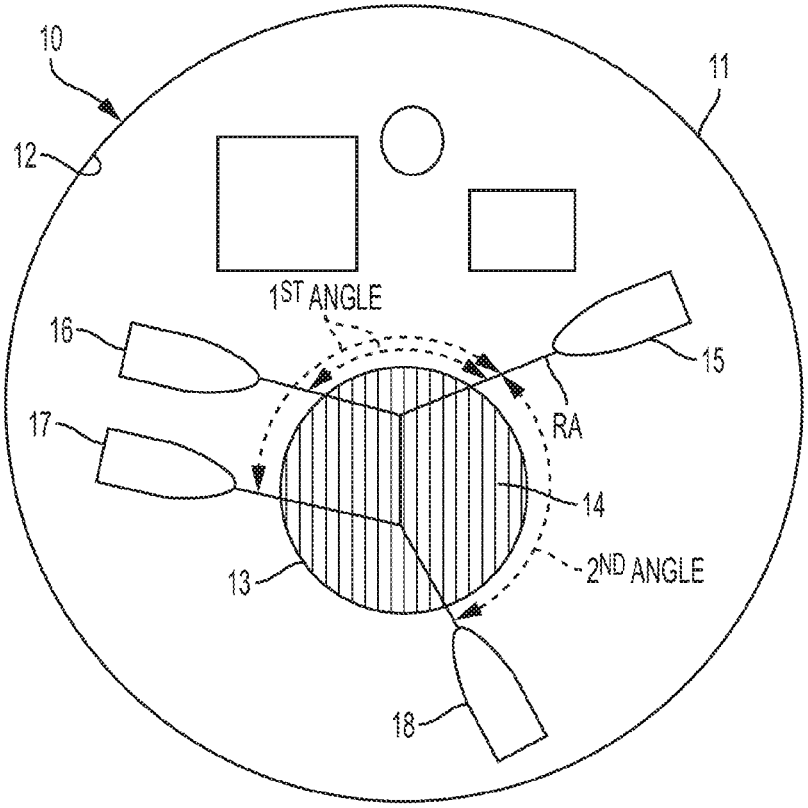
FIG. 1 is a plan view of a smoke detector in accordance with embodiments.
Figure 2:
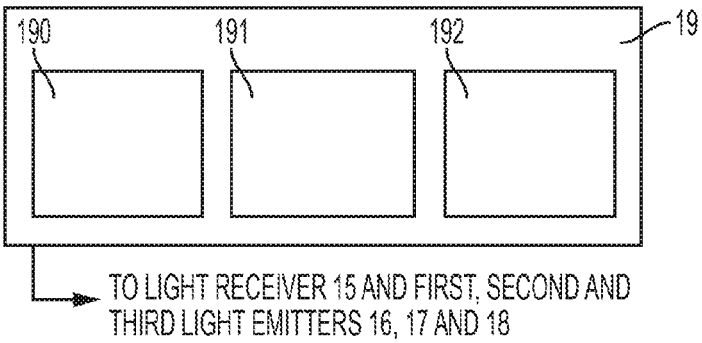
FIG. 2 is a schematic diagram of components of the smoke detector of FIG. 1.

With reference to FIGS. 1 and 2, a smoke detector 10 is provided and may be configured as a photo-electric smoke detector 11. The photo-electric smoke detector 11 includes a housing 12 that is formed to encompass multiple features and components of the photo-electric smoke detector 11 and to define a chamber 13 in an interior thereof. The chamber 13 is generally open to surroundings of the photo-electric smoke detector 11 and is thus receptive of ambient materials 14 through a grating or another similar feature. The ambient materials 14 may include air as well as smoke and non-smoke particles that are carried by the air. The photo-electric smoke detector 11 further includes a light receiver 15, a first light emitter 16, a second light emitter 17, a third light emitter 18 and a controller 19.

The light receiver 15 is disposed within the housing 12 to receive light that is emitted by the first, second and third light emitters 16, 17 and 18 and then is reflected from the chamber 13 by the ambient materials 14 toward the light receiver 15 along a light receiving axis RA of the light receiver 15. The light receiver 15 may be provided as any suitable photo-electric light receiving element and is configured to generate an output electric signal in accordance with light being received. That is, for light that is emitted by the first light emitter 16, reflected by the ambient materials 14 in the chamber 13 and then received by the light receiver 15 along the light receiving axis RA, the light receiver 15 generates a first output signal. Similarly, for light that is emitted by the second and third light emitters 17 and 18, reflected by the ambient materials 14 in the chamber 13 and then received by the light receiver 15 along the light receiving axis RA, the light receiver 15 generates second and third output signals, respectively.

The first light emitter 16 may be disposed within the housing 12 to emit light of a first wavelength into the chamber 13 at a first angle relative to the light receiving axis RA. The first light emitter 16 may be provided as a light emitting diode (LED) for example and may be configured to emit long wavelength light (e.g., infrared light). The first angle may be obtuse or greater than 90 degrees. The second light emitter 17 may be disposed within the housing 12 to emit light of a second wavelength into the chamber 13 at the first angle (e.g., obtuse or greater than 90 degrees) relative to the light receiving axis RA. The second light emitter 17 may be provided as a light emitting diode (LED) for example and may be configured to emit short wavelength light (e.g., blue wavelength light). The third light emitter 18 may be disposed within the housing 12 to emit light of the first wavelength into the chamber 13 at a second angle relative to the light receiving axis RA. The third light emitter 18 may be provided as a light emitting diode (LED) for example and may be configured to emit long wavelength light. The second angle may be acute or less than 90 degrees.

The controller 19 may be configured to determine whether a current condition of the chamber 13 should trigger an alarm based on the first, second and third output signals of the light receiver 15. As shown in FIG. 2, the controller 19 may include a signal processing and alarm decision unit 190, a light emitter driver 191 and a current controller 192. The light emitter driver 191 and the current controller 192 may be provided as a single element or as standalone components and are cooperatively coupled to the first, second and third light emitters 16, 17 and 18 to thereby control various operations thereof.

Figure 3:
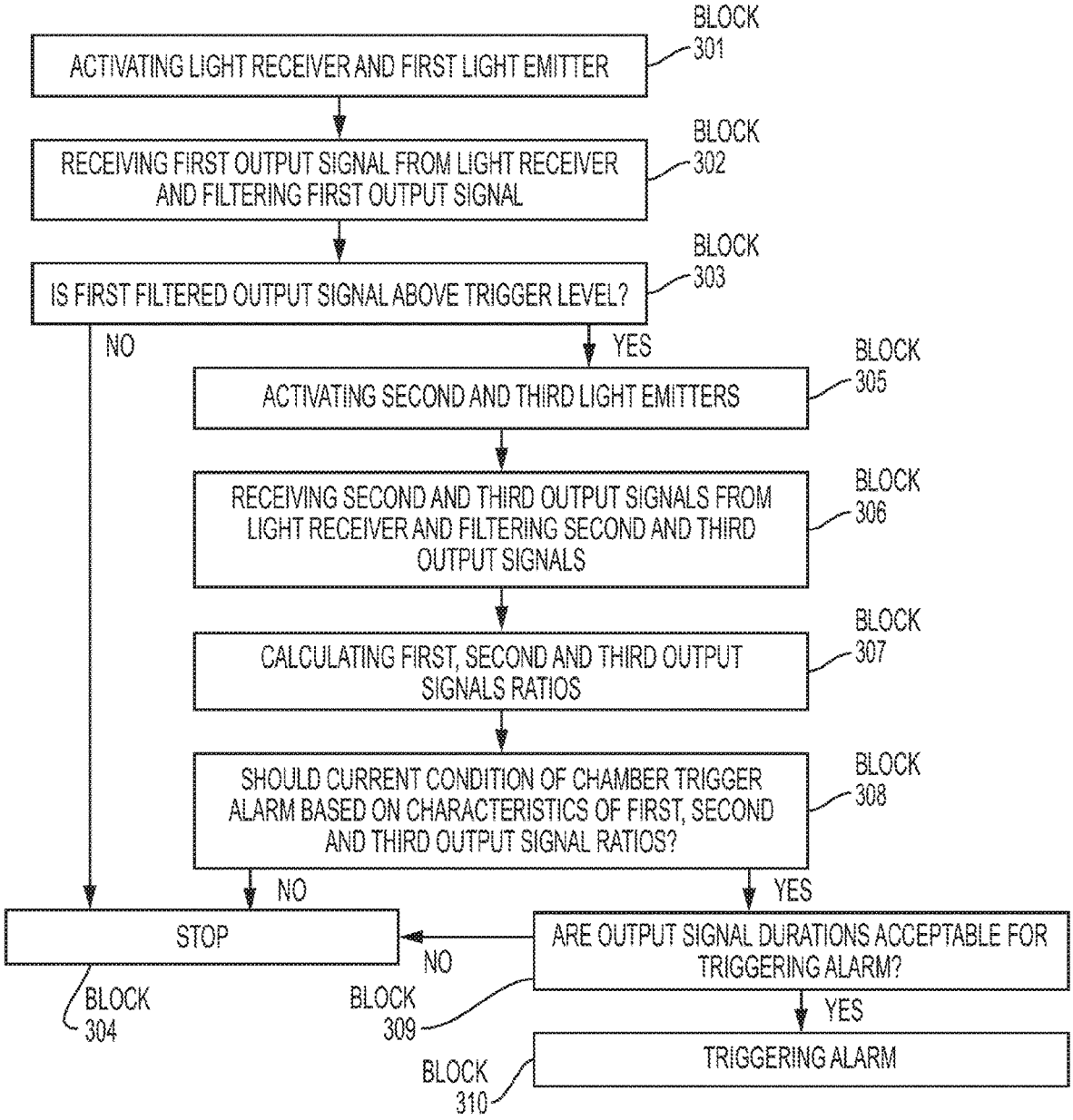
FIG. 3 is a flow diagram illustrating an operation of the smoke detector of FIGS. 1 and 2.

With reference to FIG. 3, during operations of the photo-electric smoke detector 11, which could include testing operations and on-site and in-use operations, the controller 19 activates the light receiver 15 and causes the first light emitter 16 to emit light into the chamber 13 (block 301). Any ambient materials 14 that are in the chamber 13 at that point will then reflect that light in accordance with a particle size of the ambient materials 14 and the wavelength of the light as dictated by Rayleigh scattering principles. For example, the long wavelength light emitted by the first light emitter 16 will be forward scattered toward the light receiver 15 by particles of a certain size and will be back scattered away from the light receiver 15 by particles of a different certain size.

The controller 19 will then receive the first output signal from the light receiver 15 and will be able to associate that signal with the emission times of the first light emitter 16. At this point, the controller 19 filters or digitally filters the first output signal (block 302) and determines whether the filtered first output signal is above a trigger level (block 303). In an event the filtered first output signal is not above a trigger level, no alarm is triggered by the controller 19 and the process stops (block 304).

In an event the filtered first output signal is above a trigger level, the controller 19 causes the second and third light emitters 17 and 18 to emit light into the chamber 13 (block 305). At this point, ambient materials 14 that are in the chamber 13 will reflect that light in accordance with a particle size of the ambient materials 14 and the wavelength of the light as dictated by Rayleigh scattering principles. For example, the short wavelength light emitted by the second light emitter 17 will be forward scattered toward the light receiver 15 by particles of a certain size and will be back scattered away from the light receiver 15 by particles of a different certain size and long wavelength light emitted by the third light emitter 18 will be forward scattered away from the light receiver 15 by particles of a certain size and will be back scattered toward the light receiver 15 by particles of a different certain size.

The controller 19 will then receive and filter the second and third output signals from the light receiver 15 and will be able to associate those filtered signals with the emission times of the second and third light emitters 17 and 18 (block 306). At this point, the controller 19 calculates first, second and third output signal ratios (block 307). The first output signal ratio may include for example relative strengths of the first and second output signals, the second output signal ratio may include for example relative strengths of the first and third output signals and the third output signal ratio may include for example relative strengths of the second and third output signals. In any case, the first, second and third signal ratios may be indicative of the current condition of the chamber 13 corresponding to a real fire that requires an alarm to be triggered or a nuisance, such as dust, steam or smoke from a "hamburger test" penetrating into the chamber 13 that dictates that no such alarm should be triggered.

Thus, the controller 19 is then able to determine whether the current condition of the chamber 13 should trigger the alarm based on characteristics of the first, second and third output signal ratios (block 308). If not, the controller 19 does not trigger the alarm and the process stops. On the other hand, if the controller 19 determines that the current condition of the chamber 13 should trigger the alarm based on the characteristics of the first, second and third output ratios, the controller 19 determines whether first, second and third output signal durations are acceptable for triggering the alarm (block 309). Here, the first, second and third output signal durations can be relied upon by the controller 19 to identify false alarm scenarios or incorrect readings of the light receiver 15. If not, the controller 19 does not trigger the alarm and the process stops but if the first, second and third output signal durations are acceptable, the controller 19 triggers the alarm (block 310).

In particular, the controller 19 may be configured to determine whether the current condition of the chamber 13 should trigger an alarm in satisfaction of UL 217-8 and 268-7 standards.

Figure 4:
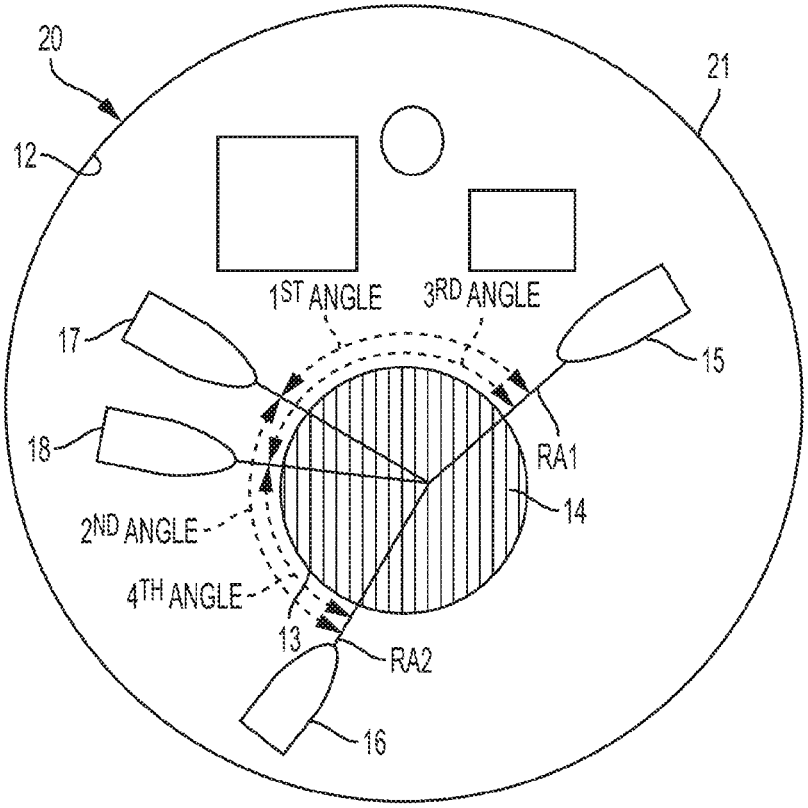
FIG. 4 is a plan view of a smoke detector in accordance with alternative embodiments.
Figure 5:
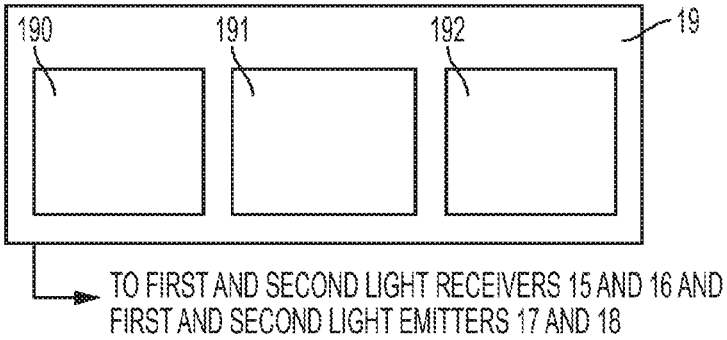
FIG. 5 is a schematic diagram of components of the smoke detector of FIG. 4.

With reference to FIGS. 4 and 5, a smoke detector 20 is provided and may be configured as a photo-electric smoke detector 21. The photo-electric smoke detector 21 has many of the same components and structures as the photo-electric smoke detector 11 of FIGS. 1 and 2 and therefore a detailed description of those components and structures is not needed.

The photo-electric smoke detector 21 includes a first light receiver 15, a second light receiver 16, a first light emitter 17, a second light emitter 18 and a controller 19.

The first light receiver 15 is disposed within the housing 12 to receive light that is emitted by the first and second light emitters 17 and 18 and then is reflected from the chamber 13 by the ambient materials 14 toward the first light receiver 15 along a first light receiving axis RA1 of the first light receiver 15. The light receiver 15 may be provided as any suitable photo-electric light receiving element and is configured to generate an output electric signal in accordance with light being received. That is, for light that is emitted by the first and second light emitters 17 and 18, reflected by the ambient materials 14 in the chamber 13 and then received by the first light receiver 15 along the first light receiving axis RA1, the first light receiver 15 generates first and second output signals, respectively.

The second light receiver 16 is disposed within the housing 12 to receive light that is emitted by the first and second light emitters 17 and 18 and then is reflected from the chamber 13 by the ambient materials 14 toward the second light receiver 16 along a second light receiving axis RA2 of the second light receiver 16. The second light receiver 16 may be provided as any suitable photo-electric light receiving element and is configured to generate an output electric signal in accordance with light being received. That is, for light that is emitted by the first and second light emitters 17 and 18, reflected by the ambient materials 14 in the chamber 13 and then received by the second light receiver 16 along the second light receiving axis RA2, the second light receiver 15 generates third and fourth output signals, respectively.

The first light emitter 17 may be disposed to emit light of a first wavelength into the chamber 13 at a first angle relative to the first light receiving axis RA1 and at a second angle relative to the second light receiving axis RA2. The first light emitter 17 may be provided as a light emitting diode (LED) for example and may be configured to emit long wavelength light. The first angle may be obtuse or greater than 90 degrees and the second angle maybe acute or less than 90 degrees. The second light emitter 18 may be disposed to emit light of a second wavelength into the chamber 13 at a third angle relative to the first light receiving axis RA1 and at a fourth angle relative to the second light receiving axis RA2. The second light emitter 18 may be provided as a light emitting diode (LED) for example and may be configured to emit short wavelength light. The third angle may be obtuse or greater than 90 degrees and the fourth angle maybe acute or less than 90 degrees.

The controller 19 may be configured to determine whether a current condition of the chamber 13 should trigger an alarm based on the first and second output signals of the first light receiver 15 and the third and fourth output signals of the second light receiver 16. As shown in FIG. 5, the controller 19 may include a signal processing and alarm decision unit 190, a light emitter driver 191 and a current controller 192. The light emitter driver 191 and the current controller 192 may be provided as a single element or as standalone components and are cooperatively coupled to the first and second light emitters 17 and 18 to thereby control various operations thereof.

Figure 6:
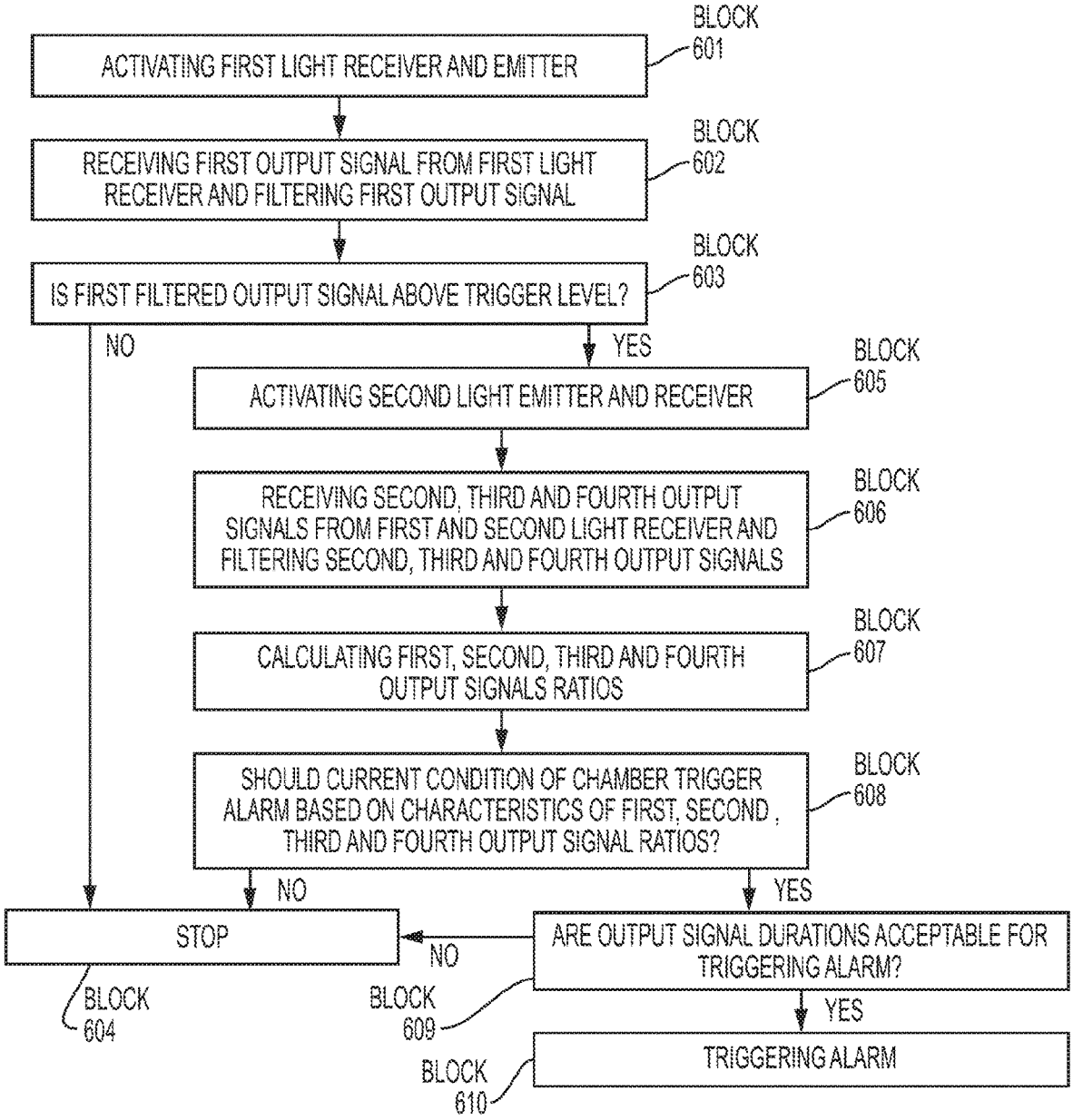
FIG. 6 is a flow diagram illustrating an operation of the smoke detector of FIGS. 4 and 5.

With reference to FIG. 6, during operations of the photoelectric smoke detector 21, which could include testing operations and on-site and in-use operations, the controller 19 activates the first light receiver 15 and causes the first light emitter 17 to emit light into the chamber 13 (block 601). Any ambient materials 14 that are in the chamber 13 at that point will then reflect that light in accordance with a particle size of the ambient materials 14 and the wavelength of the light as dictated by Rayleigh scattering principles. For example, the long wavelength light emitted by the first light emitter 17 will be forward scattered toward the first light receiver 15 by particles of a certain size and will be back scattered toward the second light receiver 16 by particles of a different certain size.

The controller 19 will then receive the first output signal from the first light receiver 15 and will be able to associate that signal with the emission times of the first light emitter 17. At this point, the controller 19 filters or digitally filters the first output signal (block 602) and determines whether the filtered first output signal is above a trigger level (block 603). In an event the filtered first output signal is not above a trigger level, no alarm is triggered by the controller 19 and the process stops (block 604).

In an event the filtered first output signal is above the trigger level, the controller 19 activates the second light receiver 16 and causes the first and second light emitters 17 and 18 to emit light into the chamber 13 (block 605). At this point, ambient materials 14 that are in the chamber 13 will reflect that light in accordance with a particle size of the ambient materials 14 and the wavelength of the light as dictated by Rayleigh scattering principles. For example, long wavelength light emitted by the first light emitter 17 will be forward scattered toward the first light receiver 15 by particles of a certain size and will be back scattered toward the second light receiver 16 by particles of a different certain size. Conversely, short wavelength light emitted by the second light emitter 18 will be forward scattered toward the first light receiver 15 by particles of a certain size and will be back scattered toward the second light receiver 16 by particles of a different certain size.

The controller 19 will then receive and filter the first, second, third and fourth output signals from the first and second light receivers 15 and 16 and will be able to associate those signals with the emission times of the first and second light emitters 17 and 18 (block 606). At this point, the controller 19 calculates first, second, third and fourth output signal ratios (block 607) as relative strengths of the first, second, third and fourth output signals. In any case, the first, second, third and fourth signal ratios may be indicative of the current condition of the chamber 13 corresponding to a real fire that requires an alarm to be triggered or a nuisance, such as dust, steam or smoke from a "hamburger test" penetrating into the chamber 13 that dictates that no such alarm should be triggered.

Thus, the controller 19 is then able to determine whether the current condition of the chamber 13 should trigger the alarm based on characteristics of the first, second, third and fourth output signal ratios (block 608). If not, the controller 19 does not trigger the alarm and the process stops. On the other hand, if the controller 19 determines that the current condition of the chamber 13 should trigger the alarm based on the characteristics of the first, second, third and fourth output ratios, the controller 19 determines whether first, second, third and fourth output signal durations are acceptable for triggering the alarm (block 609). Here, the first, second, third and fourth output signal durations can be relied upon by the controller 19 to identify false alarm scenarios or incorrect readings of the light receiver 15. If not, the controller 19 does not trigger the alarm and the process stops but if the first, second, third and fourth output signal durations are acceptable, the controller 19 triggers the alarm (block 610).

In particular, the controller 19 may be configured to determine whether the current condition of the chamber 13 should trigger an alarm in satisfaction of UL 217-8 and 268-7 standards.

Figure 7:
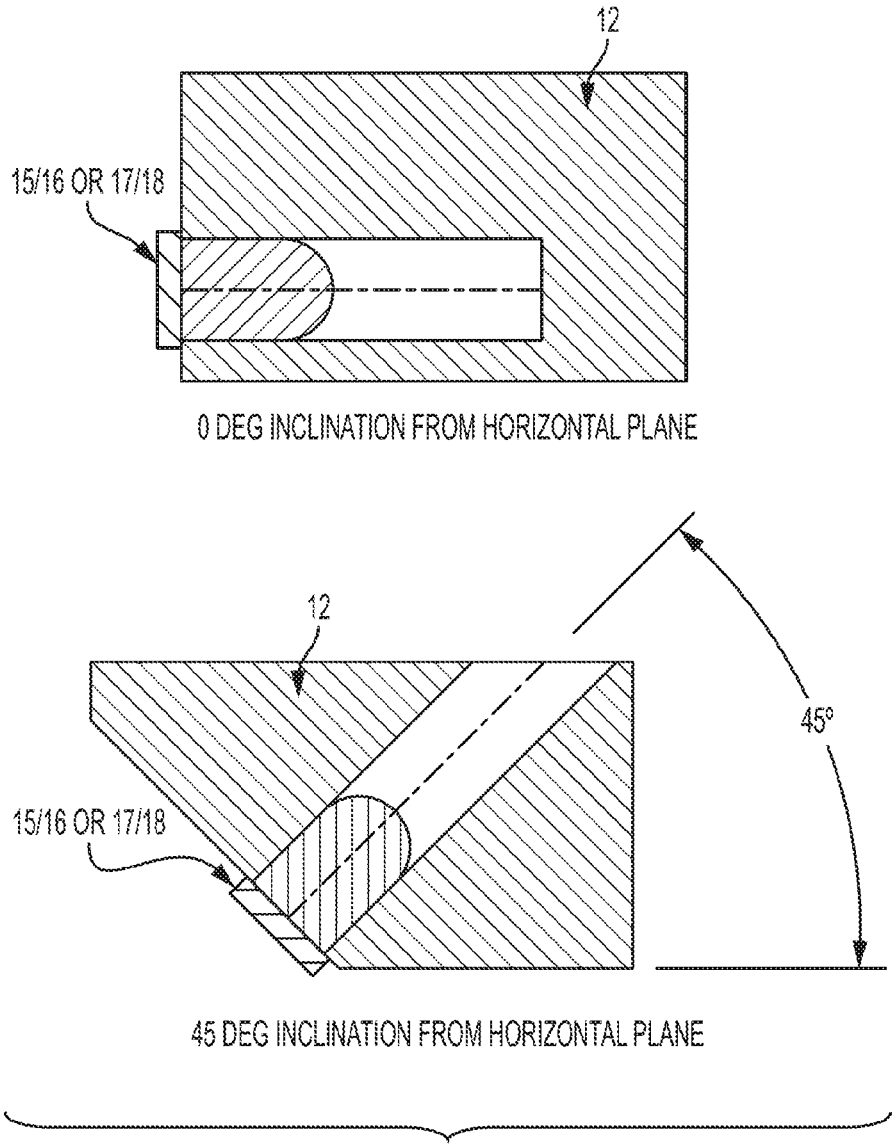
FIG. 7 is a schematic illustration of relative angling between light receivers, light emitters, a housing an a horizontal plane.

In accordance with further embodiments and, with reference to FIG. 7, it is to be understood that the light receivers 15 and 16 and the light emitters 17 and 18 can be disposed and mounted within the housing 12 at various angles relative to each other and relative to a horizontal plane. For example, the light receivers 15 and 16 and the light emitters 17 and 18 can be disposed and mounted within the housing 12 at a same angle relative to a horizontal plane with such angle being anywhere from about 0° to about 45° or more. As an alternative example, one or more of the light receivers 15 and 16 and the light emitters 17 and 18 can be disposed and mounted within the housing 12 at a different angle relative to a horizontal plane as compared to another one or more of the light receivers 15 and 16 and the light emitters 17 and 18. Again, such various angles may be anywhere from about 0° to about 45° or more (e.g., light receiver 15 can be mounted at 23° relative to the horizontal plane and light emitter 17 can be mounted at 18° relative to the horizontal plane).

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A smoke detector, comprising:

a housing defining a chamber receptive of ambient materials;

a receiver disposed to receive light reflected from the chamber along a receiving axis;

first, second and third emitters disposed to emit light of first, second and first wavelengths, respectively, into the chamber at first, first and second angles relative to the receiving axis, respectively; and a controller configured to determine whether a current condition of the chamber should trigger an alarm based on output signals generated by the receiver resulting from light emitted into the chamber by the first, second, and third emitters being reflected toward the receiver by the ambient materials, wherein the controller is configured to:

activate the receiver;

cause the first light emitter to emit light into the chamber for reception by the receiver whereupon the receiver generates a first output signal;

receive and filter the first output signal from the receiver and determine whether the received and filtered first output signal is above a trigger level;

cause the second and third light emitters to emit light into the chamber for reception by the receiver whereupon the receiver generates second and third output signals, respectively;

calculate first, second and third output signal ratios based on the first, second and third output signals, and determine whether the current condition should trigger the alarm based on respective durations of the first, second and third output signal ratios.

2. The smoke detector according to claim 1, wherein the ambient materials comprise air and non-smoke particles carried by the air.

3. The smoke detector according to claim 1, wherein the first angle relative to the receiving axis comprises an obtuse angle, the second angle relative to the receiving axis comprises an acute angle and the light of the first and second wavelengths comprises long and short wavelength light, respectively.

4. The smoke detector according to claim 1, wherein the controller comprises:

a signal processing and alarm decision unit; and a light emitter driver and current controller to control operation of the first, second, and third emitters.

5. The smoke detector according to claim 1, wherein the first output signal ratio is a ratio of relative strengths of the first and second output signals, the second output signal ratio is a ratio of relative strengths of the first and third output signals, the third output signal ratios is a ratio of relative strengths of the second and third output signals and the first, second and third output signal ratios are indicative of a real fire or a nuisance.

6. The smoke detector according to claim 1, wherein the controller is configured to determine whether the current condition should trigger an alarm in satisfaction of UL 217-8 standards.

7. The smoke detector according to claim 1, wherein the receiver and the first, second, and third emitters are mounted at similar or varied angles relative to a plane.

8. A smoke detector, comprising:

a housing defining a chamber receptive of ambient materials;

first and second receivers disposed to receive light reflected from the chamber along first and second receiving axes, respectively;

first and second emitters disposed to emit light of first and second wavelengths, respectively, into the chamber at first and second and third and four angles relative to each of the first and second receiving axes, respectively, and at a same 0° angle relative to a common plane; and a controller configured to determine whether a current condition of the chamber should trigger an alarm based on output signals generated by the first and second receivers resulting from light emitted into the chamber by the first and second emitters being reflected toward the first and second receivers by the ambient materials, wherein:

the first and second angles are measured in opposite directions from a same emission axis along which the first emitter emits the light of the first wavelengths and the first angle is greater than the second angle in absolute magnitude, the third and fourth angles are measured in opposite directions from a same emission axis along which the second emitter emits the light of the second wavelengths and the third angle is greater than the fourth angle in absolute magnitude, the first and third angles are obtuse, the second and fourth angles are acute, and the light of the first and second wavelengths comprises long and short wavelength light, respectively.

9. The smoke detector according to claim 8, wherein the ambient materials comprise air and smoke and non-smoke particles carried by the air.

10. The smoke detector according to claim 8, wherein the controller comprises:

a signal processing and alarm decision unit; and a light emitter driver and current controller to control operations of the first, second and third emitters.

11. The smoke detector according to claim 8, wherein the controller:

receives first and second output signals from the first receiver and third and fourth output signals from the second receiver, calculates first, second, third and fourth output signal ratios, and determines whether the current condition should trigger the alarm based on the first, second, third and fourth output signal ratios.

12. The smoke detector according to claim 11, wherein the first, second, third and fourth output signal ratios are indicative of a real fire or a nuisance.

13. The smoke detector according to claim 11, wherein the controller determines whether the current condition should trigger the alarm based on first, second and third output signal durations.

14. The smoke detector according to claim 8, wherein the controller is configured to determine whether the current condition should trigger an alarm in satisfaction of UL 217-8 standards.

15. A method of operating a smoke detector comprising a housing defining a chamber, one or more receivers disposed to receive light reflected from the chamber along one or more receiving axes, respectively, and multiple emitters disposed to emit light of multiple wavelengths, respectively, into the chamber at multiple angles relative to each of the one or more receiving axes, respectively, the method comprising:

receiving, from the one or more receivers, output signals resulting from light emitted into the chamber by the multiple emitters being reflected toward the one or more receivers by ambient materials in the chamber; and determining whether a current condition of the chamber should trigger an alarm based on output signal ratios calculated from the output signals and output signal durations, wherein the determining comprises:

activating one of the one or more receivers;

causing a first one of the multiple emitters to emit light into the chamber for reception by the one of the one or more receivers whereupon the one of the one or more receivers generates a first output signal;

receiving and filtering the first output signal from the one of the one or more receivers and determining whether the received and filtered first output signal is above a trigger level;

causing second and third ones of the multiple emitters to emit light into the chamber for reception by the one of the one or more receivers whereupon the one of the one or more receivers generates second and third output signals, respectively;

calculating first, second and third output signal ratios based on the first, second and third output signals, and determining whether the current condition should trigger the alarm based on respective durations of the first, second and third output signal ratios.

16. The method according to claim 15, wherein the output signal ratios and the output signal durations are indicative of the current condition being a real fire or a nuisance and the calculating comprises:

calculating the first output signal ratio as a ratio of relative strengths of the first and second output signals;

calculating the second output signal ratio as a ratio of relative strengths of the first and third output signals; and calculating the third output signal ratio as a ratio of relative strengths of the second and third output signals.

17. The method according to claim 15, wherein the determining satisfies UL 217-8 standards.

* * * * *